US008525110B2

(12) United States Patent
Herrero et al.

(10) Patent No.: US 8,525,110 B2
(45) Date of Patent: Sep. 3, 2013

(54) WIND ION NEUTRAL COMPOSITION APPARATUS

(75) Inventors: Federico Herrero, Glenn Dale, MD (US); Hollis H. Jones, Gassville, AR (US); Theodore T. Finne, Fairfax, VA (US); Andrew Nicholas, Olney, MD (US)

(73) Assignee: The United States of America as represented by the Administrator of the National Aeronautics Space Administration, Washington, DC (US)

( * ) Notice: Subject to any disclaimer, the term of this patent is extended or adjusted under 35 U.S.C. 154(b) by 209 days.

(21) Appl. No.: 13/247,168

(22) Filed: Sep. 28, 2011

(65) Prior Publication Data

US 2013/0075601 A1 Mar. 28, 2013

(51) Int. Cl.
*H01J 49/26* (2006.01)

(52) U.S. Cl.
CPC ..... *H01J 49/26* (2013.01)
USPC ..... 250/288; 250/281; 250/282

(58) Field of Classification Search
USPC ..... 250/288, 281, 282
See application file for complete search history.

(56) References Cited

U.S. PATENT DOCUMENTS

2011/0278448 A1* 11/2011 Syrstad ..... 250/282

* cited by examiner

*Primary Examiner* — Kiet T Nguyen

(57) ABSTRACT

Embodiments of the present invention pertain to an apparatus that provides four simultaneous ion and neutral measurements as a function of altitude with variable sensitivity for neutral atmospheric species. The variable sensitivity makes it possible to extend the measurements over the altitude range of 100 to more than 700 kilometers. The four instruments included in the apparatus are a neutral wind-temperature spectrometer, an ion-drift ion-temperature spectrometer, a neutral mass spectrometer, and an ion mass spectrometer. The neutral wind-temperature spectrometer and ion-drift ion-temperature spectrometer are configured to separate O and $N_2$ and O+ from H+ while the neutral mass spectrometer and the ion mass spectrometer are configured to separate mass with a resolution of one in sixty-four to enable metallic ion identification in the lower thermosphere. The energy analyzer features of the wind-temperature spectrometer and ion-drift ion-temperature spectrometer also enable the measurement of the thermosphere-to-exosphere transition in the Earth's upper atmosphere.

20 Claims, 11 Drawing Sheets

WIND ION NEUTRAL COMPOSITION APPARATUS

ORIGIN OF THE INVENTION

The invention described herein was made by an employee of the United States Government and may be manufactured and used by or for the Government for Government purposes without the payment of any royalties thereon or therefore.

FIELD

The present invention relates to a wind ion neutral composition apparatus and, more particularly, to a wind ion neutral composition apparatus that includes a suite of spectrometers to facilitate measurements of atmospheric neutrals, neutral winds, neutral density, neutral temperature, neutral composition, ion density, ion composition, ion drift speeds, and ion temperatures.

BACKGROUND

Long-standing issues in the ionosphere-thermosphere include (1) thermosphere-to-exosphere transition, (2) the vertical variation of momentum balance as evidenced by neutrals and ion drifts, densities, and temperature, and (3) the true measure of the atomic oxygen density without internal ion source contamination.

SUMMARY

Certain embodiments of the present invention may provide solutions to the problems and needs in the art that have not yet been fully identified, appreciated, or solved by current analyzers. Embodiments described herein pertain to analyzers that provide energy-angle distribution of Maxwellian and non-Maxwellian ions and neutrals. With a mass spectrometer mounted on a high velocity payload (e.g., 4 km/s), some embodiments of the present invention can yield the following: 1-horizontal neutral wind, horizontal ion drift, 2-neutral and ion temperatures, and relative densities of major species (e.g., O/N2, H+/O+, ion and neutral composition up to 200 atomic mass units (amu) to include metallic neutrals and ions).

In one embodiment of the present invention, an apparatus is provided that includes a plurality of spectrometers, a plurality of micro-channel plates, and a plurality of anodes. Each spectrometer is configured to receive ions and neutrals. The plurality of micro-channel plates is configured to create a cloud of electrons as the ions exit the plurality of spectrometers. The plurality of anodes is configured to detect the cloud of electrons as the cloud of electrons exits the plurality of micro-channel plates.

In another embodiment of the present invention, a method includes receiving, at a plurality of spectrometers, ions and neutrals. The method also includes creating, by a plurality of micro-channel plates, a cloud of electrons as ions exit the plurality of spectrometers. The method further includes detecting, by a plurality of anodes, the cloud of electrons as the cloud of electrons exits the plurality of micro-channel plates.

In yet another embodiment of the present invention, an apparatus is provided that includes a plurality of spectrometers configured to receive ions and neutrals and a set of micro-channel plates, each operatively connected to one of the spectrometers. The apparatus also includes a plurality of anodes, each anode operatively connected to one of the micro-channel plates. The plurality of spectrometers includes a first spectrometer unit configured to receive the ions or neutrals, and a second spectrometer unit configured to receive the ions and neutrals simultaneously. The plurality of spectrometers also includes a third spectrometer unit orthogonal to the second spectrometer unit that is configured to receive the ions and neutrals simultaneously.

BRIEF DESCRIPTION OF THE DRAWINGS

For a proper understanding of the invention, reference should be made to the accompanying figures. These figures depict only some embodiments of the invention and are not limiting of the scope of the invention. Regarding the figures.

DETAILED DESCRIPTION OF THE EMBODIMENTS

It will be readily understood that the components of the present invention, as generally described and illustrated in the figures herein, may be arranged and designed in a wide variety of different configurations. Thus, the following detailed description of the embodiments of an apparatus, a system, a method, and a computer readable medium, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of "certain embodiments," "some embodiments," or other similar language, throughout this specification refers to the fact that a particular feature, structure, or characteristic described in connection with the embodiment may be included in at least one embodiment of the present invention. Thus, appearances of the phrases "in certain embodiments," "in some embodiments," "in other embodiments," or other similar language, throughout this specification do not necessarily all refer to the same group of embodiments, and the described features, structures, or characteristics may be combined in any suitable manner in one or more embodiments.

Many embodiments of the present invention pertain to a suite of spectrometers that have low size, weight and power to cover a large quantity of measures, such as atmospheric neutrals, neutral winds, neutral density, neutral temperature, ion density, ion composition, ion drift speeds, and ion temperatures, as well as any other measurements that would be appreciated by a person of ordinary skill in the art.

Figure 1:
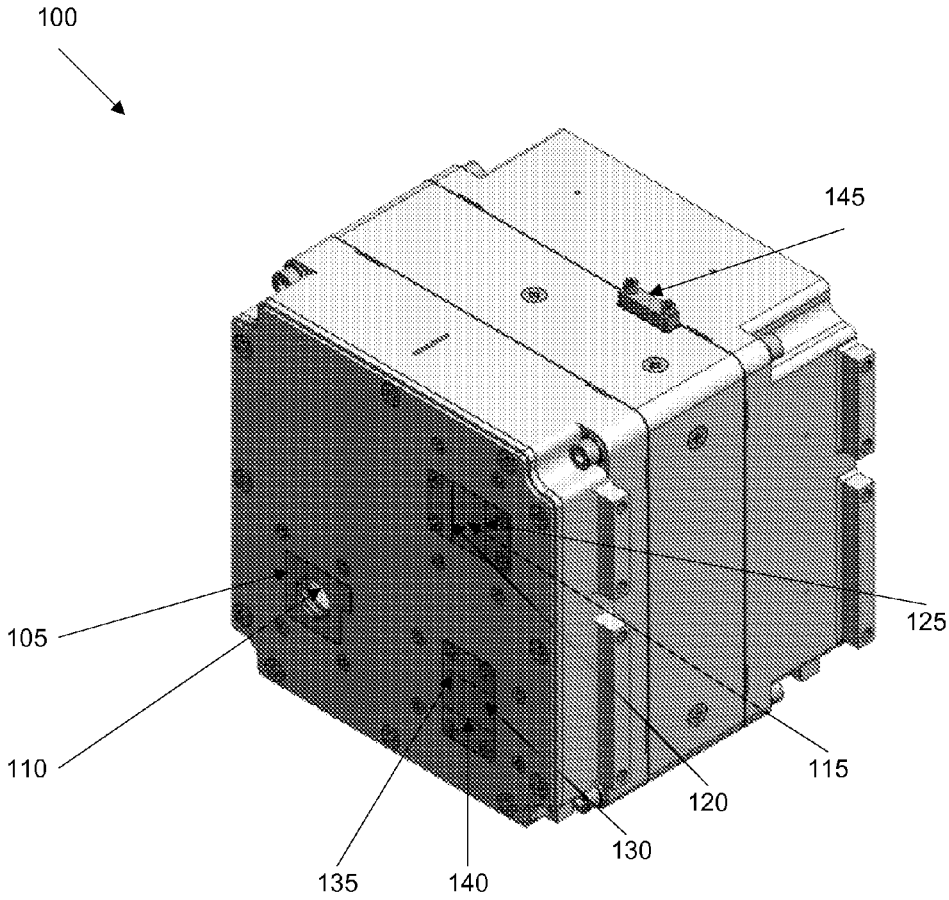
FIG. 1 illustrates a wind ion neutral composition suite (WINCS) apparatus, in accordance with an embodiment of the present invention.

FIG. 1 illustrates a wind ion neutral composition suite (WINCS) apparatus 100, in accordance with an embodiment of the present invention. In this embodiment, WINCS apparatus 100 is approximately 3 inches×3 inches×2.8 inches, but may have any desired dimensions, as would be appreciated by a person of ordinary skill in the art. The front face of WINCS apparatus 100 includes a plurality of spectrometers. For instance, WINCS apparatus 100 includes a gated electrostatic mass spectrometer (GEMS) 105 and two neutral wind-temperature spectrometer (WTS)/ion-drift ion-temperature spectrometer (IDTS) 115, 130.

GEMS 105 can be a combination of an ion mass spectrometer (IMS) and a neutral mass spectrometer (NMS) in some embodiments. GEMS (or a first unit) 105 includes a circular opening 110 that allows neutrals (or neutral particles) and ions to enter or flow into the spectrometer. WTS/IDTS (or a second unit) 115 includes vertical slits 120, 125 in order to receive ions and neutrals, and WTS/IDTS (or a third unit) 130 includes horizontal slits 135, 140 in order to receive ions and neutrals.

The top face of WINCS apparatus 100 includes an electrical connector 145. Electrical connector 145 is configured to receive power from a spacecraft or aircraft in order to power WINCS apparatus 100. Electrical connector 145 is also configured to transmit data to the spacecraft.

Figure 2:
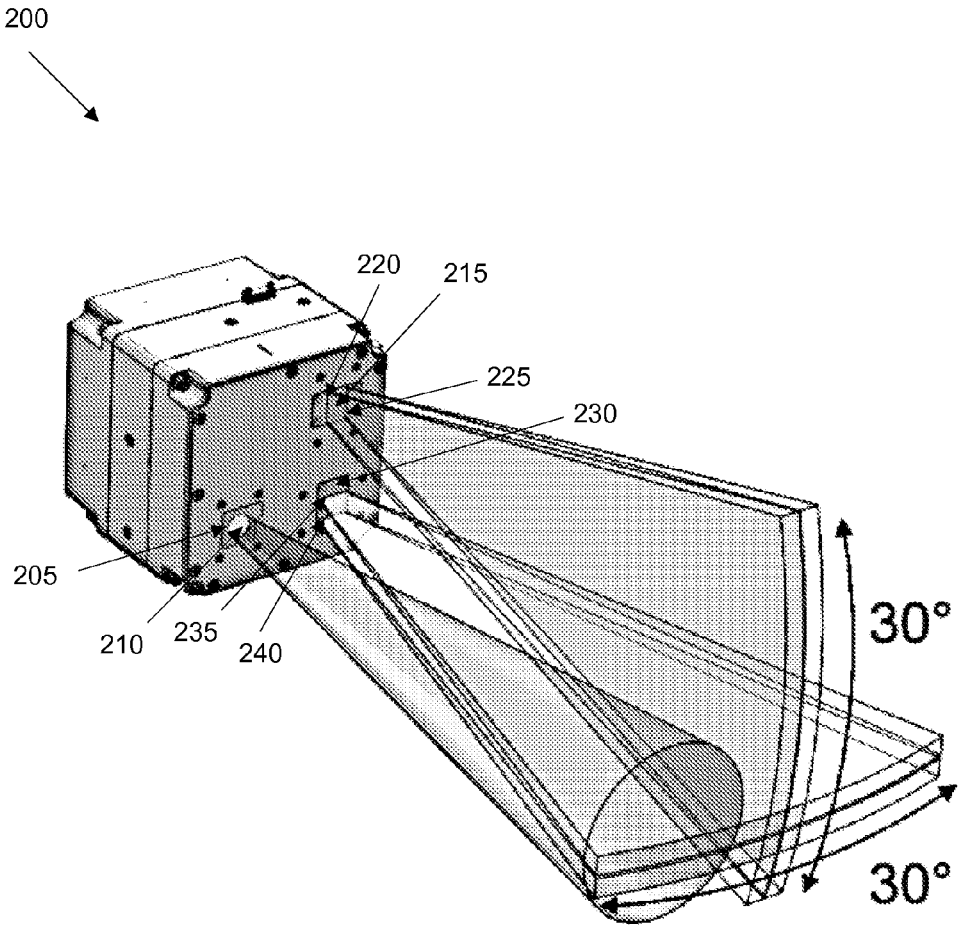
FIG. 2 illustrates a WINCS apparatus with a field of view for each unit, in accordance with an embodiment of the present invention.

FIG. 2 illustrates a WINCS apparatus 200 with a field of view for each unit, in accordance with an embodiment of the present invention. As with FIG. 1, WINCS apparatus 200 includes a first unit 205, a second unit 215, and a third unit 230.

First unit 205 includes a circular opening 210 that allows ions and/or neutrals to enter at an angle of 30 degrees. Because first unit 205 includes circular opening 210, first unit 205 has a conical field of view and receives any neutrals and/or ions (i.e., particles) in the conical field of view.

Second unit 215 includes vertical slits 220, 225 that allow particles to enter at 30 degrees in a vertical direction and a few degrees in a horizontal direction. Third unit 230 is rotated 90 degrees (or orthogonal) to first unit 215 so that particles entering slits 235, 240 can enter at 30 degrees in a horizontal direction and a few degrees in the vertical direction. It should be appreciated that the 30 degrees for vertical slits 220, 225 and horizontal slits 235, 240 can be considered to be the field of view at which ions and neutrals can enter the units. It should be appreciated that the field of view allows measurements of incidence of the ions and neutrals coming along the vertical 30 degree angle for second unit 215 and the horizontal 30 degree angle for third unit 230.

Figure 3:
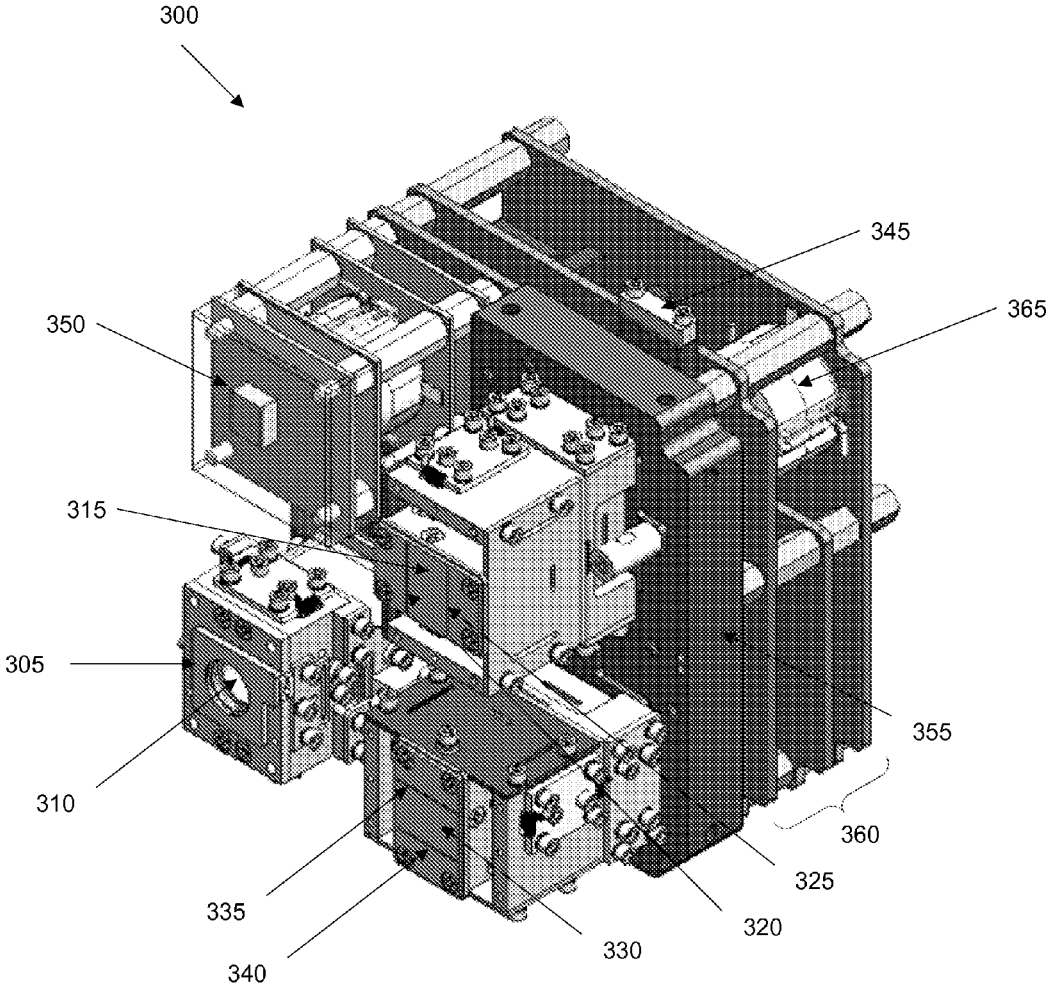
FIG. 3 illustrates internal components of a WINCS apparatus, in accordance with an embodiment of the present invention.

FIG. 3 illustrates internal components of WINCS apparatus 300, in accordance with an embodiment of the present invention. WINCS apparatus 300 includes a first spectrometer unit (GEMS) 305 having a circular opening 310, a second spectrometer unit (WTS/IDTS) 315 having vertical slits 320, 325, a third spectrometer unit (WTS/IDTS) 330 having horizontal slits 335, 340, an electrical connector 345, a first power supply 350, a housing 355, an electronic stack 360, and a second power supply 365.

First unit 305 combines an ion mass spectrometer (IMS) and a neutral mass spectrometer (NMS) into a single spectrometer. Second unit 315 and third unit 330 allow for measurements of energy and angle, or wind-temperature $O/N_2$ ratio and ion drift-temperature density ratios (e.g., at low altitudes and high altitudes). Second unit 315 includes vertical slits 320, 325 for neutrals and ions, respectively. Third unit 330 includes horizontal slits 335, 340 for neutrals and ions, respectively.

Figure 5:
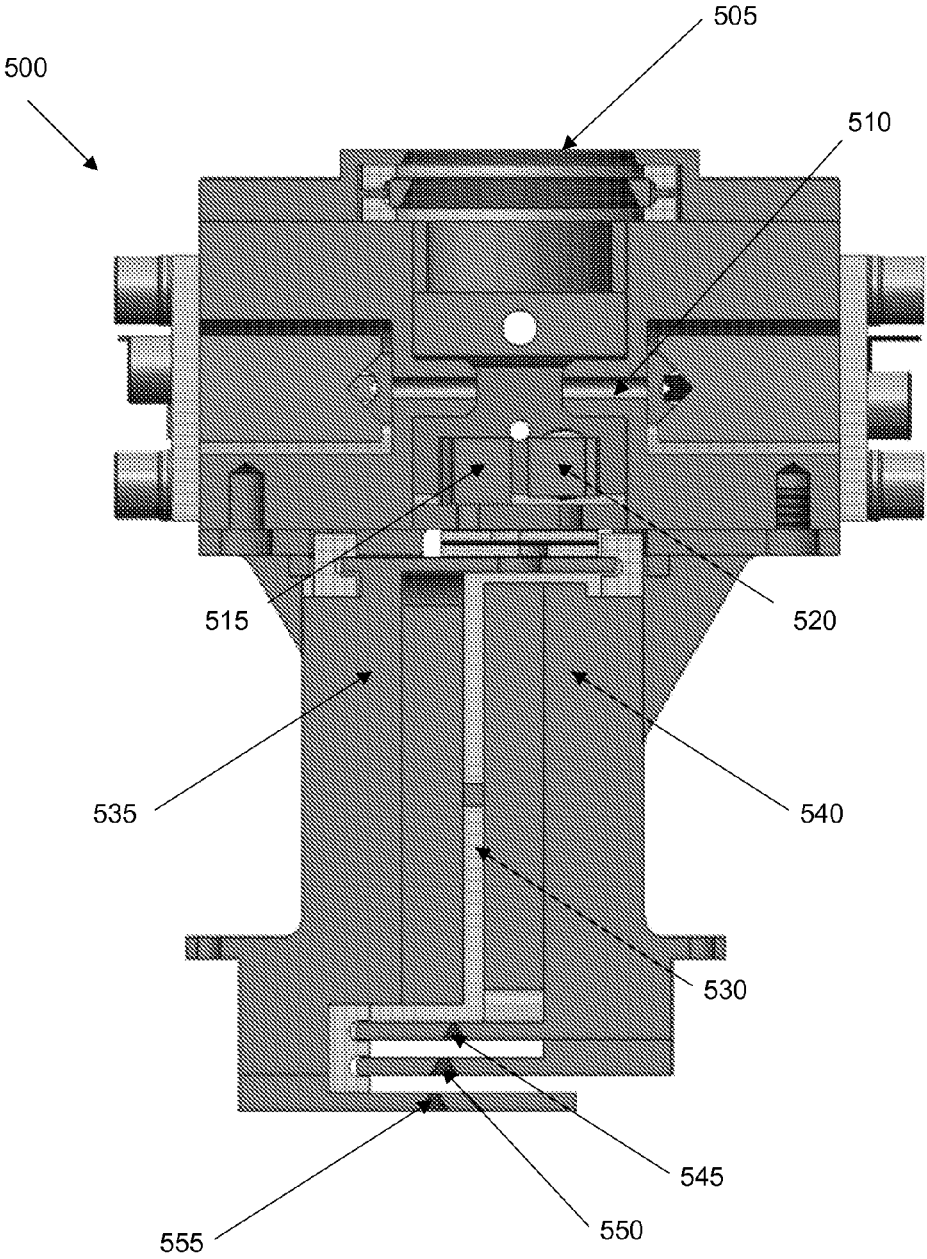
FIG. 5 illustrates a gated electro-static mass spectrometer (GEMS) apparatus, in accordance with an embodiment of the present invention.
Figure 6:
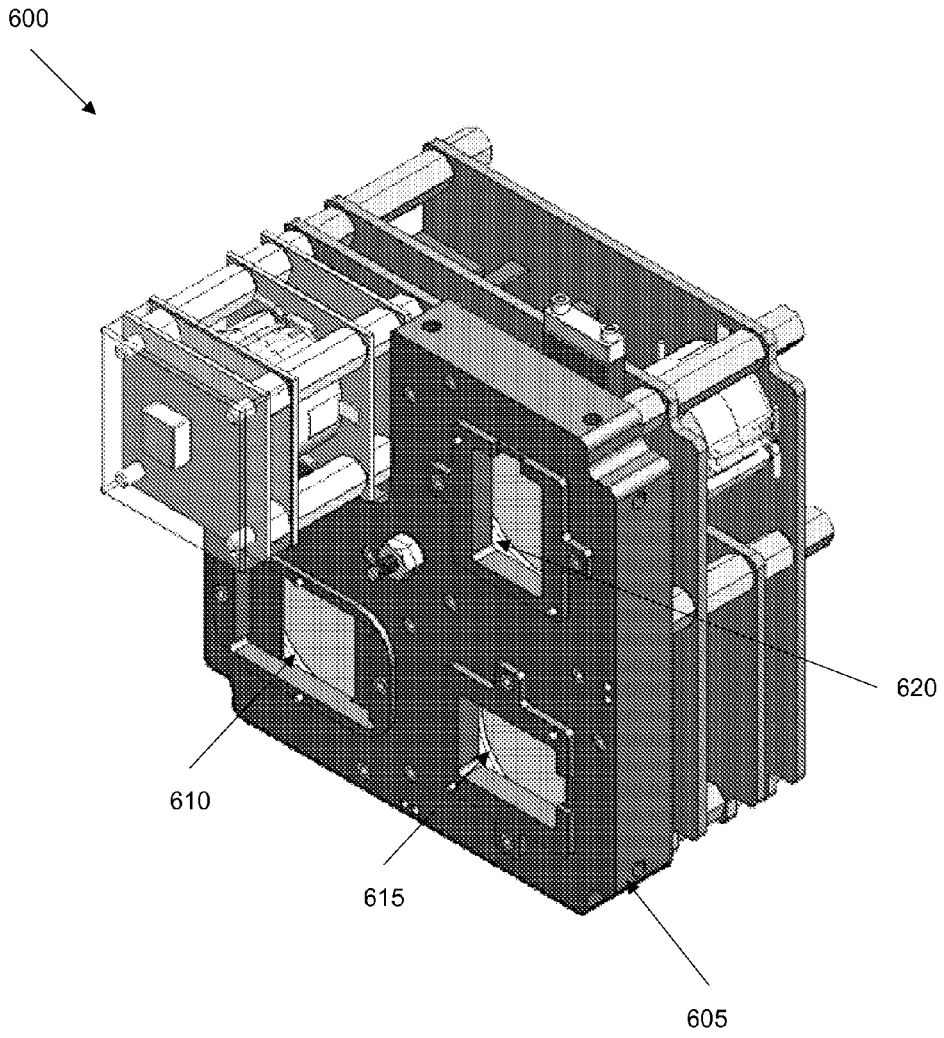
FIG. 6 illustrates a WINCS apparatus, in accordance with an embodiment of the present invention.

Power supply 350 can be a high voltage power supply and is configured to power multiple micro-channel plates (see FIGS. 5 and 6). For example, the high voltage from power supply 350 may be used to accelerate electrons through the micro-channel plates to allow an anode, which can be located behind the micro-channel plates, to detect a signal as the electrons exit the micro-channel plates.

Housing 355 includes a plurality of micro-channel plates (see FIGS. 5 and 6), and is configured to sense ions and/or neutral particles as they flow out from the spectrometers. For instance, housing 355 includes a set of three micro-channel plates, one for each spectrometer unit (e.g., first unit 305, second unit 315, and third unit 330). By enclosing the micro-channel plates in housing 355, extraneous light and/or photons are prevented from being picked up by the plates, facilitating a more accurate reading of measurements and analysis.

In this embodiment, electronic stack 360 includes three electronic plates. However, it should be appreciated that electronic stack 360 can include any number of electronic plates that would be appreciated by a person of ordinary skill in the art. Further, electronic stack 360 utilizes an anode for each unit or spectrometer that allows for a determination to be made as to the positioning of the ions and neutral particles, as well as the number of ions and neutral particles. This will be described in more detail below.

Figure 4:
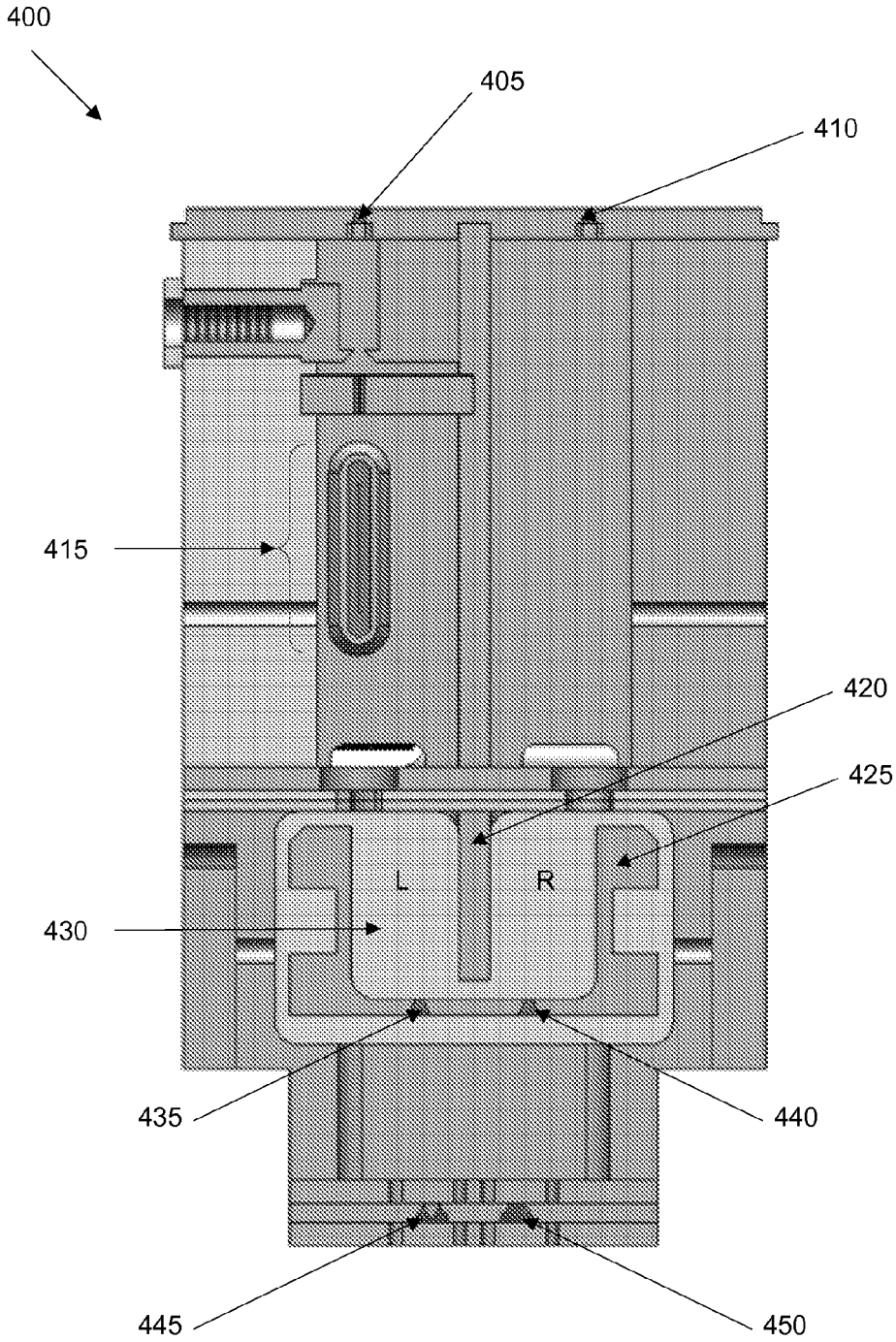
FIG. 4 illustrates a wind-temperature spectrometer/ion-drift ion-temperature spectrometer (WTS/IDTS) apparatus, in accordance with an embodiment of the present invention.

FIG. 4 illustrates a WTS/IDTS apparatus 400, in accordance with an embodiment of the present invention. WTS/IDTS apparatus 400 includes slits (or apertures) 405, 410 for neutrals and ions. It should be appreciated that slits 405, 410 allow for simultaneous intake of both neutrals and ions, respectively. However, a person of ordinary skill in the art will appreciate that WTS/IDTS apparatus 400 can be configured to receive ions and neutrals independently.

WTS/IDTS apparatus 400 also includes an ionization region 415 that includes a thermionic cathode. The thermionic cathode is configured to transmit a beam across the path of the neutrals in order to strip an electron off of the neutral. This converts the neutral atoms into an ionized particle prior to entering chamber 430 described below.

WTS/IDTS apparatus 400 also includes two small deflection energy analyzers (SDEAs) 420, 425. The space between SDEAs 420, 425 can be considered as chamber 430. By applying voltage to SDEA 425, an electric field is created in chamber 430 to cause ions to pass through chamber 430 and exit through apertures 435, 440. Chamber 430 can be interpreted by a person of ordinary skill in the art to include two chambers separated by a common wall of the two side-by-side SDEAs 420. Left chamber L can be for ionized neutral particles and the right chamber R can be for ions.

In order to create the electric field to deflect the ions passing through the chamber, two different levels of voltage are applied to SDEAs 420, 425. For instance, SDEA 420 is grounded, or set to zero volts, and SDEA 425 is set to a higher voltage depending on the deflection path. Based on the voltage applied to SDEA 425, ions from slit 410 can enter right chamber R and exit through aperture 440 and then enter the micro-channel plates via aperture 445. Neutrals, for example, that enter slit 405 are ionized by the thermionic cathode and then enter left chamber L. The ionized particles exit chamber 430 through aperture 435 based on the voltage applied to SDEA 425 and then enter the micro-channel plates via aperture 450. In other words, the two halves of WTS/IDTS apparatus 400 are for sensing ions in one half and ionized neutral particles in the other half.

Further, WTS/IDTS apparatus 400 is configured to measure the angular distribution and the energy distribution as the ions and neutrals enter. Angular distribution is defined by the size of the slit. Energy distribution is measured by changing the electro-static field within WTS/IDTS APPARATUS 400 to allow different energies to pass through the exit aperture. By analyzing the combination, the neutral winds and neutral temperature can be measured by looking at the width of the energy, the ion drifts, the ion temperature, and the ion and neutral densities.

For angular measurements, the geometry of slits 405, 410, as well as the angle at which the particles entered slits 405, 410 are considered. For instance, a particle will enter the system through slits 405, 410 at a certain angle and then pass through the system and collide with the anode situated on the electronic circuit board. Depending on the angle at which the particle enters the system, the particle will collide with one of the anodes on the strip of anodes. And, based on which anode the particle collides, a determination is made as to the angle at which the particle entered the system.

Energy is analyzed by changing the electronic field through which the ions pass. For example, as the voltage is being ramped up, energy of particles that pass through the exit slit of the SDEA is also being ramped up. This allows for an energy analysis to be conducted. For instance, when voltage is applied to a surface of SDEA 425, an electric field is created. As a result, any charged particle that flows through the electric field is affected. In other words, by changing the strength of the electric field, the flow of the particles is changed accordingly. For example, when the voltage is increased, the movement of the lower energy particles and higher energy particles is changed, such that lower energy particles move more swiftly than the higher energy particles. This allows for control of which particles (lower energy or higher energy) pass through the exit slit.

FIG. 5 illustrates a GEMS apparatus 500, in accordance with an embodiment of the present invention. GEMS apparatus 500 allows for measurements of atmospheric composition both for neutrals and ions, and uses time of flight mass spectrometry (i.e., measuring the time it takes for the particles to pass from a certain gate until the particles reach the anode) and, based on the time, the mass of the particle is determined.

GEMS apparatus 500 includes, amongst other things, a grid (or deflection lens) 505, a thermionic cathode 510, a gate system having a left (first) block 515 and a right (second) block 520, a SDEA 535 and 540, and exit apertures 545, 550, 555. In this embodiment, because GEMS apparatus 500 does not allow for neutrals and ions to enter simultaneously, GEMS apparatus 500 is configured to switch between acceptance of neutrals and ions. In order to switch between ions and neutrals, grid 505 is situated such that all ions and/or neutrals entering apparatus 500 pass through grid 505. For instance, when a positive voltage is applied to grid 505, neutrals can enter apparatus 500 and can be analyzed. The positive voltage prevents ions from entering apparatus 500 at the same time as the neutrals. In other words, when the grid 505 is activated, ions are repelled and thus prevented from entering GEMS apparatus 500. However, when zero volts are applied to grid 505, or in other words when grid 505 is deactivated, neutrals are prevented from entering GEMS apparatus 500 and ions are allowed to enter GEMS apparatus 500 and then are analyzed accordingly.

When sensing neutrals, GEMS apparatus 500 utilizes cathode 510 to strip off an electron to convert the neutral into an ion prior to entering the electric field. For instance, cathode 510 transmits a beam of electrons horizontally and hits the neutral to convert the neutral into an ionized particle.

As discussed above, in this embodiment, the gate system includes two blocks; right block 520 having a square wave voltage from 0 to 5 volts and left block 515 being grounded or at 0 volts. However, the voltage is variable, and may exceed this range, subject to design choice. For example, when right block 520 is set to 5 volts, right block 520 prevents any ions from passing through the gate system by deflecting the ions into left block 515. However, when right block 520 is set to 0 volts, ions are able to pass through the gate system and through electric field 530, which is created by SDEAs 535, 540.

As ions pass through the gate system, different voltages (e.g., −1000 volts and −1200 volts) are applied to SDEAs 535, 540 causing an electric field 530 to be created. Electric field 530 allows ions (or particles) to pass through electric field 530 and exit through apertures 545, 550, 555. After exiting through apertures 545, 550, 555, ions collide with micro-channel plates to form a cloud of electrons. It should be appreciated that the use of multiple apertures reduces the amount of scattered light.

GEMS apparatus 500 allows for measurements to be taken of the time from when the gate was opened until the particle reached the anode. For example, by setting the voltage of right block 520 of gate system 515 to 0 volts, a measurement is conducted of the time it took for particles of different masses to go from the beginning of gate system 520 to the anode. Based on the differences in the times, a determination can be made as to the type of composition the particle was, i.e., whether the particle is Nitrogen, Oxygen, etc.

FIG. 6 illustrates WINCS apparatus 600, in accordance with an embodiment of the present invention. In particular, FIG. 6 illustrates housing 605 that interfaces between GEMS and micro-channel plates 610, the two WTS/IDTS units and micro-channel plates 615, 620. As ions are colliding with micro-channel plates, if stray light were to hit micro-channel plates as well, then additional electrons would be created causing an increased background level in measurements. To prevent the disruption of measurements, housing 605 is utilized to prevent photons or light from reaching the micro-channel plates, because micro-channel plates are sensitive to photons, light, and particles such as oxygen and nitrogen.

Figure 7:
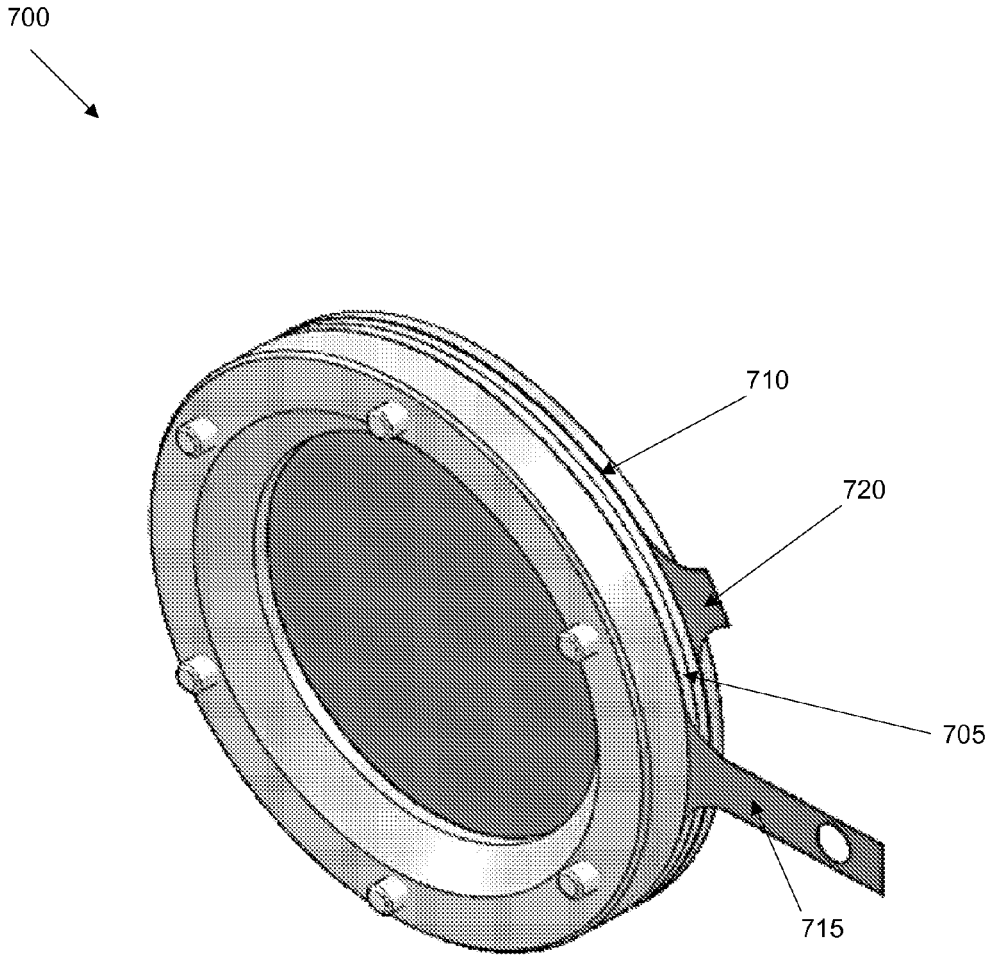
FIG. 7 illustrates multiple micro-channel plates, in accordance with an embodiment of the present invention.

FIG. 7 illustrates a set of micro-channel plates 700, in accordance with an embodiment of the present invention. In the WINCS apparatus described in the figures above, there is a set of three micro-channel plates, one for the GEMS unit and one for each WTS/IDTS unit. It should be appreciated that the set of micro-channel plates can be more or less than three depending on the number of spectrometers used, and/or the design choice. In this embodiment, the each set of three micro-channel plates includes two micro-channel plates (or glass plates) 705, 710 stacked up against each other. Each plate includes voltage connectors 715, 720, respectively, in order to receive power from the power supply.

When ions or neutrals collide with the top of plate 705, an electron is knocked off and the electron is accelerated through micro-channel plates 705, 710 by the voltage difference on the plates driven by the high voltage power supply. In order for the electrons to flow through plates 705, 710, the voltage for plate 705 may be set to −2700 volts via connector 715 and voltage for plate 710 may be set to −500 volts via connector 720. However, it should be appreciated that the voltages used are a matter of design choice. As the electron rattles through the glass pores of plates 705, 710, additional electrons are knocked off to generate a cloud of electrons. When the cloud of electrons collides with the anode (not shown), creating an electrical signal to conduct measurements.

Figure 8:
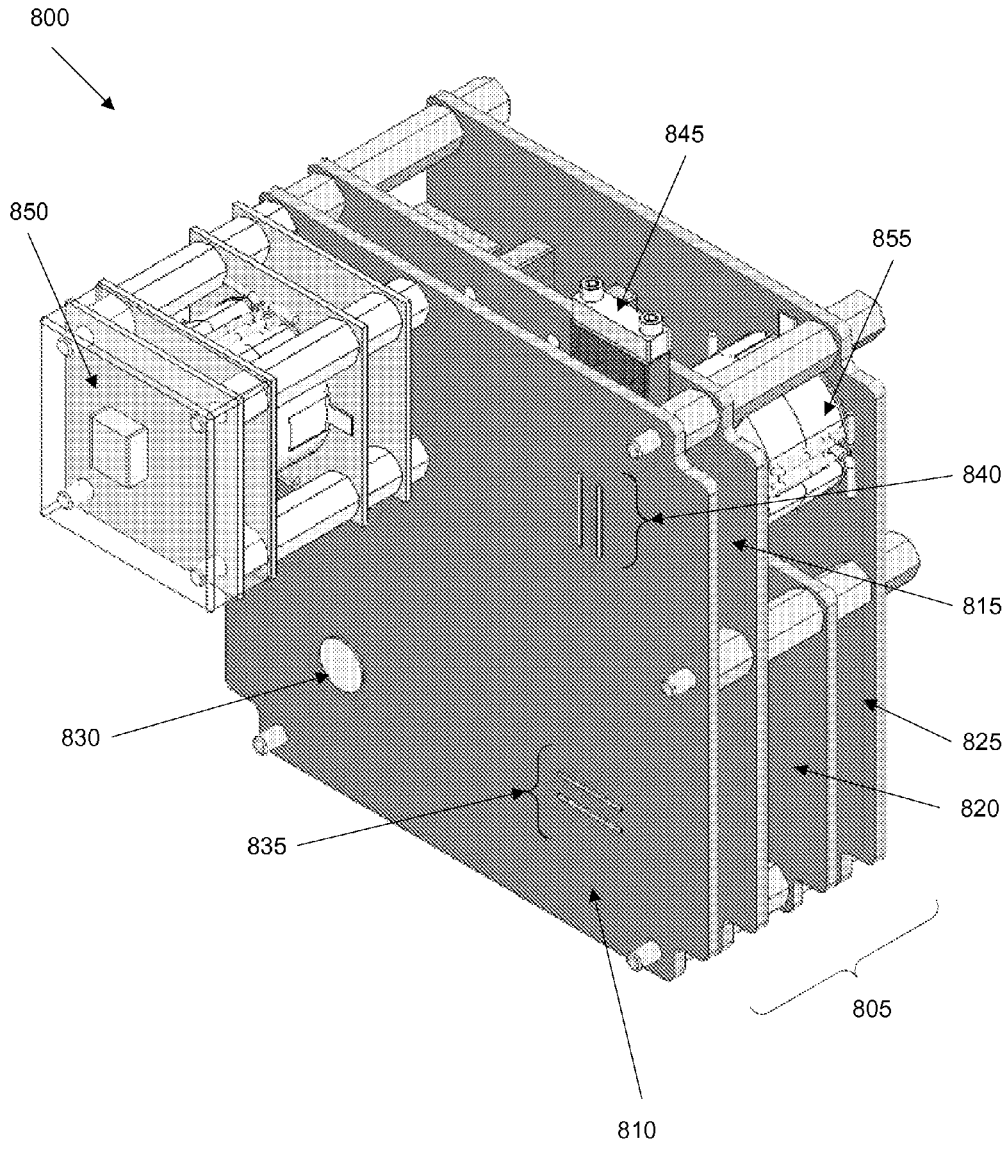
FIG. 8 illustrates a WINCS apparatus, in accordance with an embodiment of the present invention.

FIG. 8 illustrates a WINCS apparatus 800, in accordance with an embodiment of the present invention. In this embodiment, WINCS apparatus 800 includes an electronic stack 805 that includes electronic plates 810, 815, 820, 825.

Electronic plate 810 includes a plurality of anodes. In this embodiment, electronic plate 810 includes three sets of anodes 830, 835, 840, one for each instrument, i.e., the GEMS unit and the two WTS/IDTS units. Anodes 835 and 840 include 16 anodes in each strip, but may be any number that will be appreciated by a person of ordinary skilled in the art. It should be appreciated that the direction of the strip is based on the slit position in the WTS/IDTS unit.

In this embodiment, electronic stack 805 is configured to sense a cloud of electrons exiting the micro-channel plates described above via anodes 830, 835, 840. For instance, electronic stack 805 senses the cloud of electrons colliding with each anode from the respective micro-channel plates and processes the charge sensed by anodes 830, 835, 840.

For instance, when the charge is sensed on the anodes 830, 835, 840, the set of electronics for the WTS/IDTS unit is configured to setup a counter for a certain integration period and determines whether a count is detected on a particular anode. When an event occurs (that is, when ionized particles or ions collide with an anode), the event is registered on the anode, and watches for what the integration period was set to. The electronics also accumulates for a certain amount of time and, once the time is over, the electronics transmit that number to the other electronics, which processes the number. The number then gets transmitted to the spacecraft via connector.

For the GEMS unit, a counter is setup for a period of time. During the period of time, the number of events is registered as a function of time. Based on the number of events registered during the period of time, a determination is made as to the type of mass that caused the events. For example, electronic stack 805 also outputs how many events were accumulated on the integration period of each anode and, for the GEMS unit, it would be a set of timing pulses that allows for a determination to be made as to the type of the mass of the particle.

FIG. 8 also shows an electrical connector 845 situated between electronic plates 810 and 815. Electrical connector 845 receives power from the spacecraft or aircraft, as well as transmits data to the spacecraft or aircraft. Electronic plate 810 is also connected to a power supply 850 and electronic plate 825 is connected to another power supply 855. Power supplies 850, 855 may be high voltage power supplies. As discussed above, power supply 850 provides power to micro-channel plates in order to drive electrons through the micro-channel plates. Power supply 855 controls the voltages on the SDEAs in the WTS/IDTS units and the GEMS unit in order for the ions to pass through the respective units.

Figure 9:
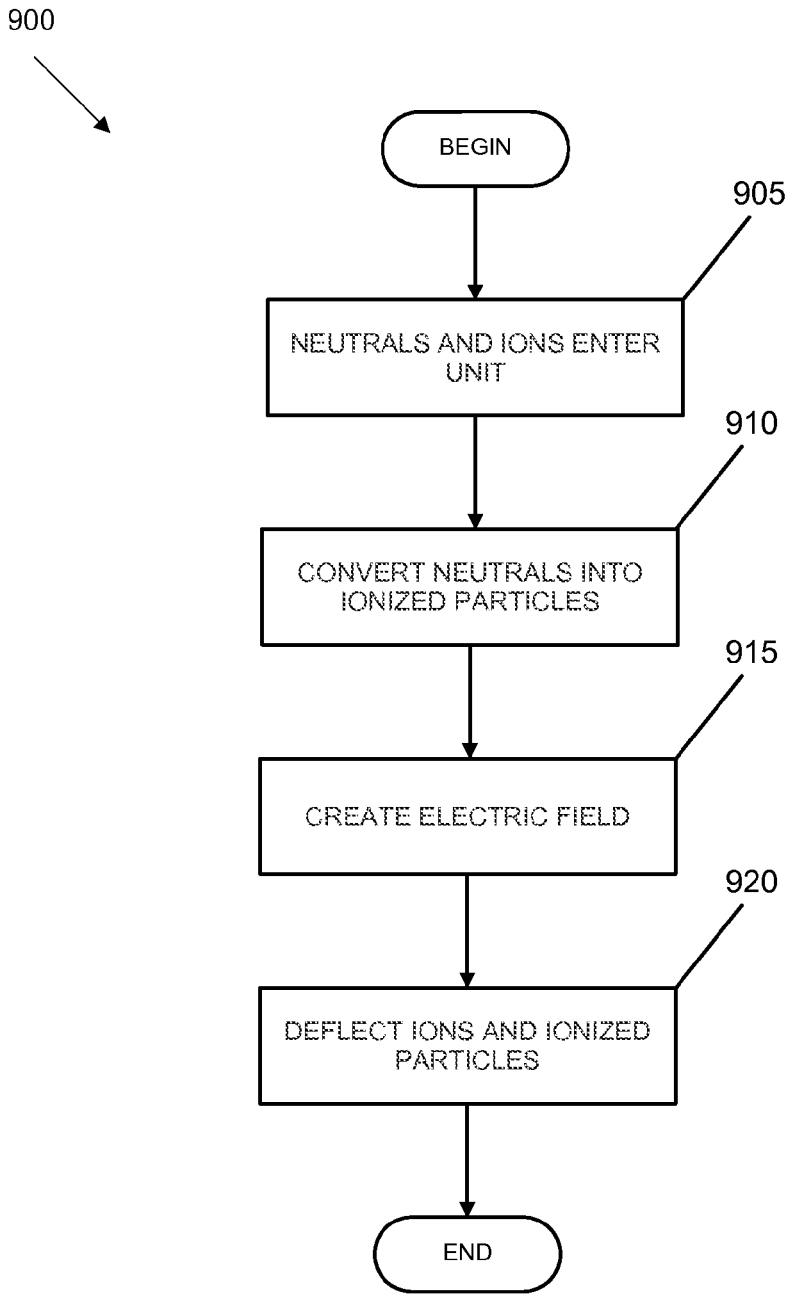
FIG. 9 illustrates a method for transmitting neutrals and particles through a WTS/IDTS unit, in accordance with an embodiment of the present invention.

FIG. 9 illustrates a method 900 for transmitting neutrals and particles through a WTS/IDTS unit, in accordance with an embodiment of the present invention. At 905, neutrals and ions enter the unit through a slit for neutrals and another slit for ions. At 910, neutrals are converted into ionized particles by utilizing a thermionic cathode. At 915, an electric field is created by applying 0 volts on the first SDEA and applying a higher voltage on the second SDEA. The electric field at 920 deflects the ions and ionized particles to exit through the exit apertures.

Figure 10:
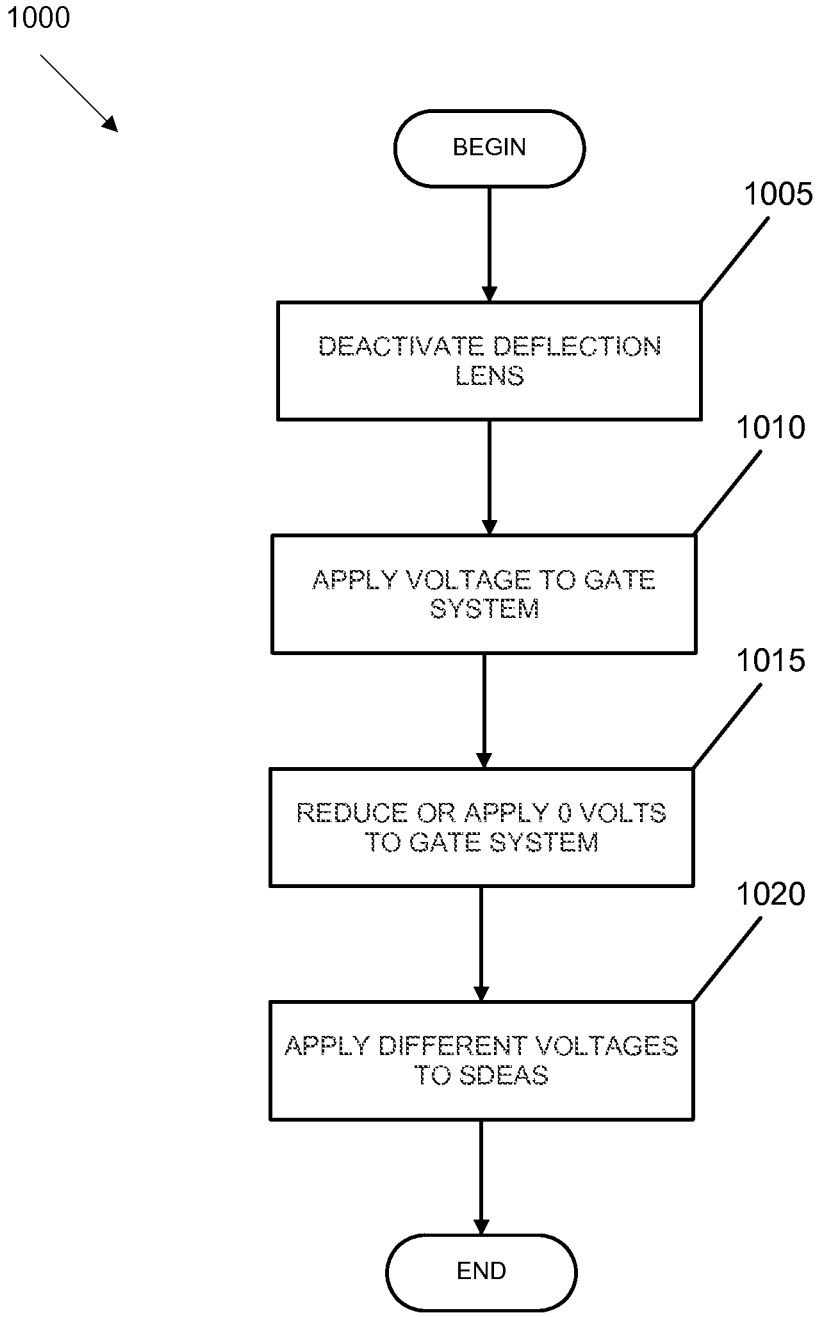
FIG. 10 illustrates a method for transmitting ion particles through a GEMS unit, in accordance with an embodiment of the present invention.

FIG. 10 illustrates a method 1000 for transmitting ion particles through the GEMS unit, in accordance with an embodiment of the present invention. At 1005, the voltage on the deflection lens is set to 0 or the lens is deactivated in order for the ions to enter the GEMS unit. At 1010, a voltage is applied to the gate system, preventing the ions from entering the electric field. At 1015, the voltage is reduced or not applied to cause the ions to pass through the electric field. At 1020, ions are deflected, causing them to exit through the exit apertures of the GEMS unit by applying different voltages to the SDEAs.

Figure 11:
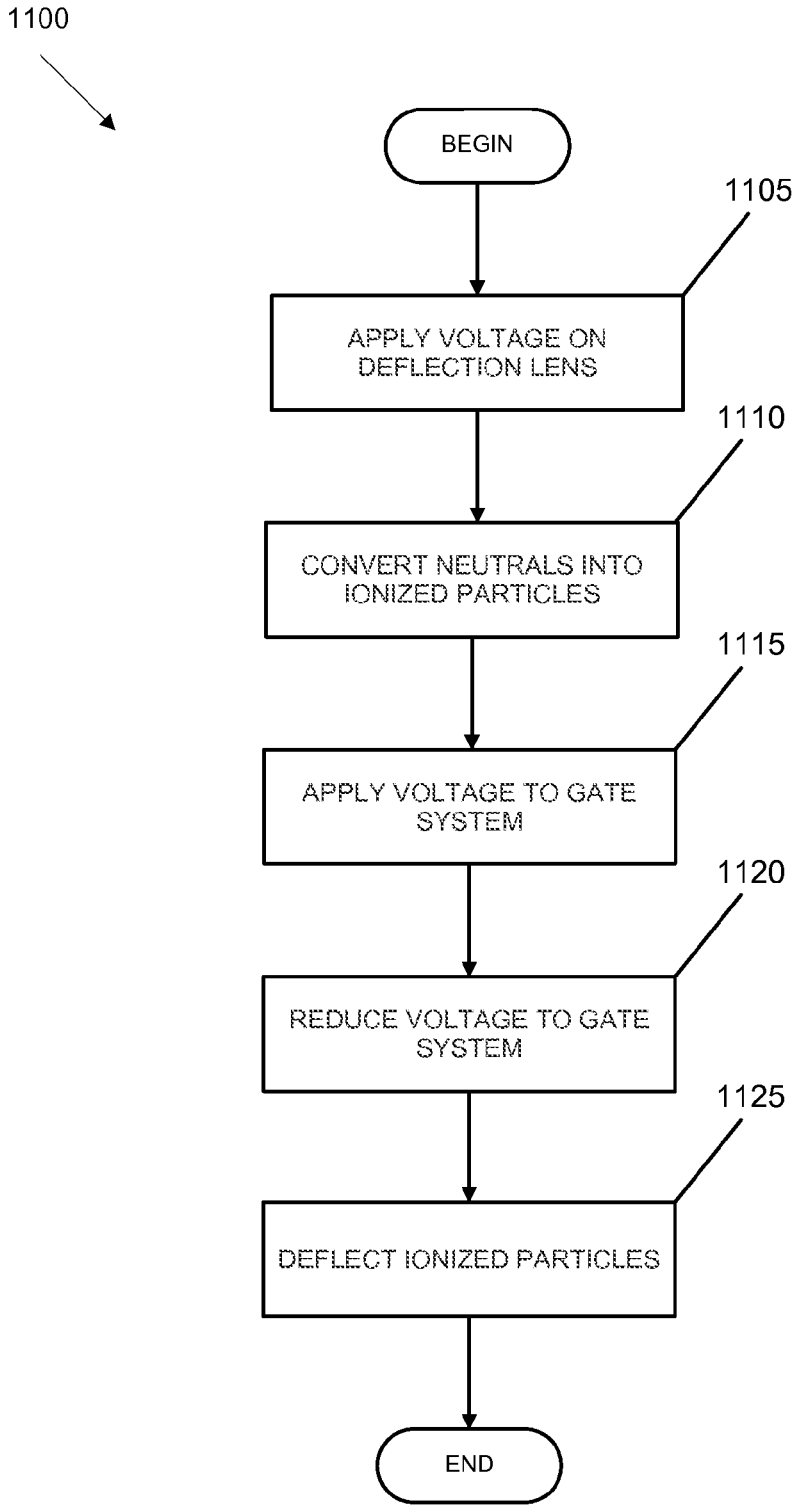
FIG. 11 illustrates a method for transmitting neutral particles through a GEMS unit, in accordance with an embodiment of the present invention.

FIG. 11 is a method 1100 for transmitting neutrals through the GEMS unit, in accordance with an embodiment of the present invention. At 1105, the voltage on the deflection lens is set to a higher voltage in order to prevent ions from entering the GEMS unit and to allow neutrals to enter the GEMS unit. At 1110, neutrals entering the GEMS unit are converted into ionized particles by using a thermionic cathode. At 1115, a voltage is applied to the gate system preventing the ionized particles from entering the electric field. At 1120, when the voltage is reduced or not applied, the ionized particles are allowed to pass to the electric field. At 1025, different voltages are applied to the SDEAs in order to deflect the ionized particles through the electric field, causing them to exit apertures of the GEMS unit.

The method steps performed in FIGS. 9 to 11 can be performed by a computer program, encoding instructions for a nonlinear adaptive processor to perform at least the methods described in FIGS. 9 to 11, in accordance with an embodiment of the present invention. The computer program may be embodied on a non-transitory computer readable medium. A computer readable medium may be, but is not limited to, a hard disk drive, a flash device, a random access memory, a tape, or any other such medium used to store data. The computer program may include encoded instructions for controlling the nonlinear adaptive processor to implement the method described in FIGS. 9 to 11, which may also be stored on the computer readable medium.

The computer program can be implemented in hardware, software, or a hybrid implementation. The computer program can be composed of modules that are in operative communication with one another, and which are designed to pass information or instructions to display. The computer program can be configured to operate on a general purpose computer, or an application specific integrated circuit ("ASIC").

One or more embodiments of the present invention pertain to an apparatus having a suite of spectrometers. The suite includes energy-angle spectrometers, i.e., a neutral wind-temperature spectrometer (WTS) and an ion-drift ion-temperature spectrometer (IDTS). The WTS can be utilized for wind-temperature —$O/N_2$ ratio and the IDTS can be utilized for ion drift-temperature-density ratios (e.g., at low altitudes and at high altitudes). The suite also includes a mass analyzer that allows two spectrometers to be combined into a single rectangular package, one half for an ion mass spectrometer (IMS) and the other half for a neutral mass spectrometer (NMS). The high payload velocity enables measurement of non-Maxwellian energy distributions and also the separation of O (oxygen) from internal ion source products.

The embodiments described above allow for variable sensitivity for neutral atmospheric species. The variable sensitivity makes it possible to extend the measurements over the altitude range of 100 km to more than 700 km. This capability will make it possible to study the coupling of multiple atmospheric regions at once, addressing questions of energy, momentum, and mass transfer from one region to another. For example, reflection and transmission of atmospheric waves between E and F regions of the ionosphere; or between the mesosphere and the thermosphere; or between the thermosphere and the exosphere. Also, the embodiments allow for high velocity coupled with the energy analyzer to provide a true measurement of the atomic oxygen density without the previous issues of internal ion source contamination.

One having ordinary skill in the art will readily understand that the invention as discussed above may be practiced with steps in a different order, and/or with hardware elements in configurations, which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

We claim:

1. An apparatus, comprising:

a plurality of spectrometers, each spectrometer configured to receive ions and neutrals;

a plurality of micro-channel plates configured to create a cloud of electrons as the ions exit the plurality of spectrometers; and a plurality of anodes configured to detect the cloud of electrons as the cloud of electrons exits the plurality of micro-channel plates.

2. The apparatus of claim 1, wherein each of the spectrometers comprises a cathode configured to convert the neutrals into an ionized particle.

3. The apparatus of claim 1, wherein each of the spectrometers further comprises an electric field created by first and second analyzers, wherein the first and second analyzers are configured to deflect ions through exit apertures of each of the spectrometers.

4. The apparatus of claim 3, wherein, based on the voltage applied to the first and the second analyzers, the ions in the electric field are deflected accordingly.

5. The apparatus of claim 1, further comprising:

a housing configured to house the plurality of micro-channel plates and prevent extraneous photons from entering the plurality of micro-channel plates.

6. The apparatus of claim 1, further comprising:

a first power supply and a second power supply, wherein the first power supply is configured to supply power to first and second analyzers in each of the spectrometers and the second power supply is configured to supply power to the plurality of micro-channel plates.

7. A method, comprising:

receiving, at a plurality of spectrometers, ions and neutrals;

creating, by a plurality of micro-channel plates, a cloud of electrons as ions exit the plurality of spectrometers; and detecting, by a plurality of anodes, the cloud of electrons as the cloud of electrons exits the plurality of micro-channel plates.

8. The method of claim 7, further comprising:

converting, by a cathode included within each spectrometer, the neutrals into ionized particles.

9. The method of claim 7, further comprising:

creating, by first and second analyzers, an electric field to deflect ions through exit apertures of each of the spectrometers.

10. The method of claim 9, further comprising:

deflecting ions in the electric field based on the voltage applied to the first and the second analyzers.

11. The method of claim 7, further comprising:

housing the plurality of micro-channel plates that prevents extraneous photons from entering the plurality of micro-channel plates.

12. The method of claim 7, further comprising:

supplying, by a first power supply, power to first and second analyzers in each of the spectrometers; and supplying, by a second power supply, power to the plurality of micro-channel plates.

13. An apparatus, comprising:

a plurality of spectrometers configured to receive ions and neutrals;

a set of micro-channel plates, each operatively connected to a spectrometer; and a plurality of anodes, each anode operatively connected to one of the micro-channel plates, wherein the plurality of spectrometers comprises a first spectrometer unit configured to receive the ions or neutrals, a second spectrometer unit configured to receive the ions and neutrals simultaneously, and a third spectrometer unit orthogonal to the second spectrometer unit configured to receive the ions and neutrals simultaneously.

14. The apparatus of claim 13, wherein the first spectrometer unit is a gated electro-static mass spectrometer, the second spectrometer unit is a combination of a neutral wind-temperature spectrometer and an ion-drift ion-temperature spectrometer, and the third spectrometer unit is a combination of a neutral wind-temperature spectrometer and an ion-drift ion-temperature spectrometer.

15. The apparatus of claim 14, wherein the first spectrometer unit comprises:

an opening configured to receive either neutrals or ions, a deflection lens configured to prevent the ions from entering the first spectrometer unit while the neutrals are entering the first spectrometer unit when a positive voltage is applied to the deflection lens, a cathode configured to convert the neutrals into ionized particles, a gate system comprising a first gate and a second gate with different charges, and first and second small deflection energy analyzers, each small deflection energy analyzer with different charges to create an electric field.

16. The apparatus of claim 15, wherein the first spectrometer unit comprises a chamber that is an area of space created by the first and the second small deflection energy analyzers.

17. The apparatus of claim 16, wherein the electric field is configured to deflect the ions through the chamber and cause the ions to exit through one or more exit apertures.

18. The apparatus of claim 14, wherein both the second and third spectrometer units comprise:

first and second slits configured to simultaneously receive neutrals and ions, respectively, a cathode configured to convert the neutrals into ionized particles, and first and second small deflection energy analyzers, each small deflection energy analyzer with different charges to create an electric field.

19. The apparatus of claim 18, wherein the second and third spectrometer units comprise a chamber that is an area between the first and the second small energy analyzers.

20. The apparatus of claim 19, wherein the electric field is configured to deflect the ions through a chamber of the second and third spectrometers and cause the ions to exit through one or more exit apertures.

* * * * *